United States Patent [19]

Dillon et al.

[11] Patent Number: 4,738,686

[45] Date of Patent: Apr. 19, 1988

[54] CETANE NUMBER

[75] Inventors: Diane M. Dillon, Yorba Linda; Peter J. Jessup, Santa Ana, both of Calif.

[73] Assignee: Union Oil Company of California, Los Angeles, Calif.

[21] Appl. No.: 944,770

[22] Filed: Dec. 22, 1986

[51] Int. Cl.[4] ..... C10L 1/18

[52] U.S. Cl. ..... 44/57; 44/77; 44/78

[58] Field of Search ..... 44/57, 78, 77

[56] References Cited

U.S. PATENT DOCUMENTS

| | | | |
|---|---|---|---|
| 2,853,494 | 9/1958 | Bell et al. | 44/57 |
| 3,658,494 | 4/1972 | Dorer, Jr. | 44/77 |
| 4,191,536 | 3/1980 | Niebylski | 44/63 |
| 4,295,860 | 10/1981 | Childs | 44/77 |
| 4,390,345 | 6/1983 | Somorjai | 44/63 |
| 4,405,335 | 9/1983 | Seemuth | 44/57 |
| 4,406,665 | 9/1983 | Filbly | 44/53 |
| 4,412,847 | 11/1983 | Dolhyj et al. | 44/77 |
| 4,522,630 | 6/1985 | Seemuth | 44/57 |

*Primary Examiner*—William R. Dixon, Jr.
*Assistant Examiner*—E. McAvoy
*Attorney, Agent, or Firm*—Dean Sandford; Gregory F. Wirzbicki; Robert A. Franks

[57] ABSTRACT

Hydrocarbon fuels with an improved cetane number are obtained by blending a liquid fuel with a cyclic ether compound. Cyclic ethers are compounds which have a ring structure of carbon and a minor number of oxygen atoms, including beta-lactones and adducts of the beta-lactones with aldehydes or ketones.

78 Claims, No Drawings

CETANE NUMBER

This invention relates to liquid hydrocarbon fuels having improved ignition characteristics, more particularly to diesel fuels with enhanced cetane numbers.

Fuel ignition in diesel engines is achieved through the heat generated by air compression, as a piston in a cylinder moves to reduce the cylinder volume during a compression stroke. In the engine, the air is first compressed, then fuel is injected into the cylinder; as fuel contacts the heated air, it vaporizes and finally begins to burn as the self-ignition temperature is reached. Additional fuel is injected during the compression stroke and this fuel burns almost instantaneously, once the initial flame has been established.

Thus, a period of time elapses between the beginning of fuel injection and the appearance of a flame in the cylinder. This period is commonly called "ignition delay" and must be quite short to avoid "diesel knock," which is caused by the accumulation and detonation of relatively large amounts of fuel before the desired smooth combustion process has been established.

A reduction in ignition delay can be obtained by varying the chemical nature of the injected fuel. Straight-chain paraffinic hydrocarbons give the least ignition delay, while branched-chain paraffins and cyclic (including aromatic) hydrocarbons tend to have poorer ignition characteristics. For this reason, n-Hexadecane ("cetane"), which is a diesel fuel having excellent ignition qualities, has long been used as a standard reference material for determining the ignition quality of commercial diesel fuels. A scale called "cetane number" has been devised for ranking the relative ignition delay characteristics of a given diesel fuel. The cetane number of an unknown fuel is determined by comparing its ignition delay in a standard test engine with reference fuels which are prepared by blending cetane (assigned a rating of 100) and 2,2,4,4,6,8,8-Heptamethylnonane (assigned a rating of 15) until a reference fuel is found to have the same ignition delay characteristics as the unknown fuel; the cetane number is obtained by the equation:

$$\text{Cetane No.} = (\text{volume \% cetane}) + [0.15\ (\text{volume \% Heptamethylnonane})]$$

In general, large stationary engines which run at fairly constant speeds and loads have the lowest cetane number requirements (e.g., 30 to 45), while smaller, motor vehicle diesel engines have the highest requirements (e.g., 40 to 55) for obtaining optimum performance. In addition to decreasing ignition delay, a higher cetane number fuel facilitates low temperature starting, provides smoother engine operation, and decreases engine deposits.

A modern petroleum refinery can produce high quality diesel fuels with large straight-chain paraffin contents. However, due to competing demands for other products, limitations imposed by poor quality heavy crude oils, and other factors, a refinery frequently is unable to meet the total demand for such diesel fuels. Because of these refining constraints, various additives have been used to increase the cetane number of diesel fuels, thereby permitting a refiner to produce large volumes of fuel which, without additives, would not be acceptable to some consumers.

SUMMARY OF THE INVENTION

The invention provides hydrocarbon fuels having an improved cetane number rating, which fuels contain a cyclic ether additive. Preferred cyclic ether compounds are diketene compounds and diketene-carbonyl adducts, which have ring structures of carbon and one or more oxygen atoms, at least one of the carbon atoms being substituted with a keto oxygen atom. Other carbon atoms can be substituted with organo groups, and unsaturation can be present in the ring. Suitable compounds are represented by diketene and 2,2,6-Trimethyl-1,3-dioxen-4-one.

The composition is prepared by blending the fuel and the additive, usually in proportions to provide at least about 0.05 percent by weight of additive in the product.

DETAILED DESCRIPTION OF THE INVENTION

In accordance with the invention, there is provided a fuel composition which possesses an enhanced cetane number rating. This composition comprises a liquid hydrocarbon fuel, to which has been added a cyclic ether compound. Cyclic ethers are compounds having a ring structure of carbon and a minor number of oxygen atoms, with adjacent carbon atoms having saturated or unsaturated bonding. Carbon atoms in the ring can be bonded to hydrogen atoms, or the hydrogen atoms can be replaced by organo groups, keto oxygen atoms, and other substituents. An "organo" group, as used herein, is an acyclic group, heteroacyclic group, alicyclic group, aromatic group, or heterocyclic group.

The term "acyclic group," as used herein, means a substituted or unsubstituted acyclic group, including saturated and unsaturated aliphatics which can be straight chain or branched chain. The "aliphatics" include alkyl, alkenyl, and alkynyl.

The term "heteroacyclic group," as used herein, means an acyclic group containing one or more heteroatoms in the chain selected from oxygen, nitrogen, and sulfur. The heteroatoms can be the same or different in each chain and usually the number of heteroatoms is one, two, or three.

The term "alicyclic group," as used herein, means a substituted or unsubstituted alicyclic group. The term "alicyclic" includes saturated or unsaturated cyclic aliphatics.

The term "aromatic group," as used herein, means a substituted or unsubstituted aromatic group. The term "aromatic" includes phenyl, naphthyl, biphenyl, anthracyl, and phenanthryl.

The term "heterocyclic group," as used herein, means a substituted or unsubstituted heterocyclic group. The term "heterocyclic" means an alicyclic or aromatic group containing one or more heteroatoms in the ring selected from oxygen, nitrogen, and sulfur. The heteroatoms can be the same or different in each ring and usually the number of heteroatoms is one, two, or three.

The terms "substituted acyclic," "substituted heteroacyclic," "substituted alicyclic," "substituted aromatic" and "substituted heterocyclic," as used herein, respectively mean an acyclic, heteroacyclic, alicyclic, aromatic, or heterocyclic group, substituted with one or more functions such as (but not limited to) alkyl, alkenyl, alkynyl, alkoxy, alkenyloxy, alkynyloxy, alkylthio, alkenylthio, alkynylthio, halo, oxo, hydroxy, carbonyl, carboxy, alkylcarbonyloxy, alkylcarbonyl, carboxyalkyl, thio, mercapto, sulfinyl, sulfonyl, imino, amino, cyano, nitro, hydroxyamine, nitroso, cycloalkyl, cycloalkylalkyl, aryl, arylalkyl, alkylaryl, aryloxy, arylalkoxy, alkylaryloxy, arylthio, arylalkylthio, alkylarylthio, arylamino, arylalkylamine, and alkylarylamino.

Preferred types of cyclic ethers include cyclic beta-lactones, having the structure:

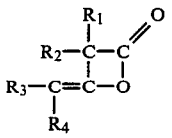

wherein $R_1$, $R_2$, $R_3$, and $R_4$ are the same or different groups selected from hydrogen and organo groups. These compounds will be referred to herein by the abbreviated term "diketene compound". One compound which is useful in the invention is commonly referred to as diketene, and is prepared by the self-condensation of ketene; the reaction is (1) below:

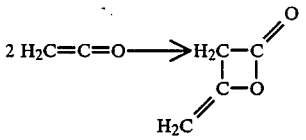

(1)

The preparation of beta-lactones has been described by D. G. Farnum, J. R. Johnson, R. E. Hess, T. B. Marshall, and B. Webster, "Aldoketene Dimers and Trimers from Acid Chlorides. A Synthesis of Substituted 3-Hydroxycyclobutenones," *Journal of the American Chemical Society,* Vol. 87, pages 5191–5197 (1965), which is incorporated herein by this reference.

While the invention is not to be bound to any particular theory, it is believed that the formation of substituted diketene compounds proceeds according to the following reactions (2) and (3), wherein R and R′ are the same or different organo groups:

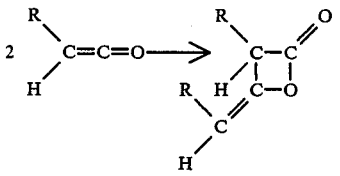

(2)

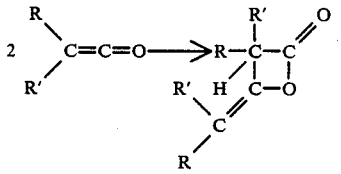

(3)

Reaction (1) generally requires no catalyst. Reaction (2) requires a catalyst such as triethylamine or triethylamine hydrochloride if R is aliphatic, or zinc chloride if R is aromatic. Reaction (3) proceeds with an aluminum chloride catalyst when R and R′ are alkyl groups.

Ketene ($CH_2{=}C{=}O$) is commercially prepared by the pyrolysis of acetic acid, while compounds in which one or both of the ketene hydrogen atoms is replaced by an organo group can be produced by the dehydrohalogenation of acid chlorides, as in reaction (4):

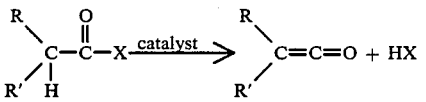

(4)

wherein X is a halogen atom.

Another preferred type of cyclic ether includes adducts of the cyclic beta-lactones and aldehydes or ketones. Certain of these compounds were reported by M. F. Carroll and A. R. Bader, "The Reactions of Diketene with Ketones," *Journal of the American Chemical Society,* Vol. 75, pages 5400–5402 (1953), which is incorporated herein by reference, and are exemplified by the reaction of diketene with acetone, to produce 2,2,6-Trimethyl-1,3-dioxen-4-one. This is shown in reaction (5):

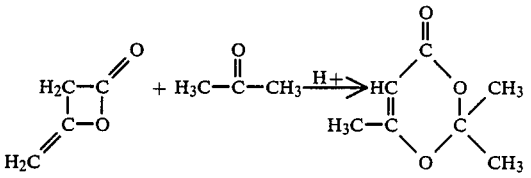

(5)

By appropriate choice of the reactants, many variations in substitution are possible, giving the more general reaction (6):

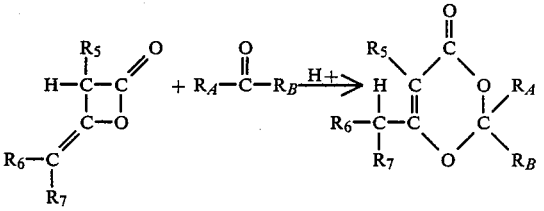

(6)

wherein $R_5$, $R_6$, $R_7$, $R_A$, and $R_B$ are the same or different and are selected from hydrogen and organo groups. The cyclic ether products of reaction (6) are referred to herein as "diketene-carbonyl adducts."

To prepare the fuel composition of the invention, a desired cyclic ether or mixture of cyclic ethers is blended with a base fuel. Preferably, the cyclic ethers chosen are soluble in the fuel. If the desired additive is not sufficiently soluble, it will be necessary to use a cosolvent for the additive and the fuel; typically, the additive will be dissolved in the cosolvent and the resulting solution will be blended with the fuel.

Useful amounts of additive in the base fuel are about 0.05 to about 10 percent by weight. Preferred amounts are about 0.05 to about 5 percent by weight, with most preferred amounts being about 0.1 to about 2 percent by weight. The upper limit of these ranges will be determined primarily by the solubility of the additive in a fuel and by the cost of the additive, since large amounts of additive can increase the cost of producing the fuel of the invention to unacceptable levels.

Fuels which are blended with the additives are generically termed "middle distillates," obtained from feedstocks which are either natural or synthetic liquid hydrocarbons. Natural liquid hydrocarbons suitable for use as feedstocks to obtain middle distillates include crude petroleum, shale oil, and tar sand bitumen. Synthetic liquid hydrocarbons which are useful as feedstocks include those derived from coal materials, peat, agricultural products (such as vegetable oils), and coke. Typical middle distillates boil in the range of 300° F. to 700° F. at atmospheric pressure; the preferred middle distillate for use in this invention is diesel fuel. Cetane number improvement is normally only important for diesel fuels, which typically have a flash point above about 100° F. The common No. 2 diesel fuel for motor vehicles typically has a specification for 90 percent of the fuel to be distilled at temperatures below about 640° F.

Diesels fuels usually contain other additives, for the purposes of modifying the structure of wax crystals which form at low temperatures (to prevent filter plugging), viscosity modification (to maintain flowability at low temperatures), the prevention of icing from water contained in the fuel, preventing microbial growth or oxidation, and others. Also, there is a trend toward the use of alcohol-containing fuels in diesel engines. The use of cyclic ether compounds in fuels which also contain other additives is specifically contemplated herein.

The invention is further illustrated by the following example which is illustrative of various aspects of the invention and is not intended to limit the scope of the invention as described by the appended claims.

EXAMPLE

An experiment is performed to assess the cetane number improvement resulting from adding cyclic ether compounds to diesel fuel.

A commercial No. 2 diesel fuel is obtained and portions are blended with a diketene compound (diketene) or a diketene-carbonyl adduct (2,2,6-Trimethyl-1,3-dioxen-4-one). Fuels so prepared and the original, unblended fuel are evaluated in a standard test engine, according to the ASTM Test for Ignition Quality of Diesel Fuels by the Cetane Method (D613).

Four engine runs are made with the unblended fuel, giving cetane numbers from 43.5 to 44.4, the average being 44.0. Fuel which contains 1.0 volume percent ketene has a cetane number of 46.2, an increase of 2.2 over the average for unblended fuel. Fuel which contains 3.0 volume percent of 2,2,6-Trimethyl-1,3-dioxen-4-one has a cetane number of 54.7, an increase of 10.7 over the average for unblended fuel.

While various specific embodiments and modifications of this invention have been described in the foregoing specification, further modifications will be apparent to those skilled in the art. Such further modifications are included within the scope of this invention as defined by the following claims.

What is claimed is:

1. A composition comprising a liquid hydrocarbon fuel and at least 0.05 percent by weight of a beta-lactone.

2. The composition defined in claim 1, wherein the fuel is suitable for use in a diesel engine.

3. The composition defined in claim 2, including at least about 0.05 to 10 percent by weight of the beta-lactone.

4. The composition defined in claim 1, wherein the beta-lactone comprises about 0.05 to about 10 percent by weight.

5. A method for operating an engine, comprising supplying the engine with a fuel comprising the composition of claim 1.

6. A composition comprising a liquid hydrocarbon fuel and at least 0.05 percent by weight of a compound having the formula:

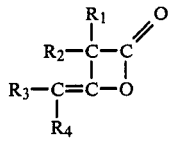

wherein $R_1$, $R_2$, $R_3$, and $R_4$ are the same or different groups selected from hydrogen and organo groups.

7. The composition defined in claim 6, wherein at least one of $R_1$, $R_2$, $R_3$, and $R_4$ is an acyclic group.

8. The composition defined in claim 6, wherein at least one of $R_1$, $R_2$, $R_3$, and $R_4$ is an alkyl group.

9. The composition defined in claim 6, wherein $R_1$, $R_2$, $R_3$, and $R_4$ are all hydrogen.

10. The composition defined in claim 6, wherein the compound comprises about 0.05 to about 5 percent by weight.

11. The composition of claim 6 wherein the fuel is a diesel fuel.

12. The composition of claim 8 wherein the fuel is a diesel fuel.

13. The composition defined in claim 6 wherein at least one of $R_1$, $R_2$, $R_3$ and $R_4$ is an aromatic group.

14. The composition as defined in claim 13 wherein said fuel is a diesel fuel.

15. The composition as defined in claim 13 wherein said fuel is a middle distillate fuel.

16. A composition comprising a liquid hydrocarbon fuel and at least 0.05 percent by weight of a compound having the formula:

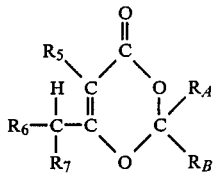

wherein $R_5$, $R_6$, $R_7$, $R_A$, and $R_B$ are the same or different groups selected from hydrogen and organo groups.

17. The composition defined in claim 16, wherein at least one of $R_5$, $R_6$, $R_7$, $R_A$ and $R_B$ is an acyclic group.

18. The composition defined in claim 16, wherein at least one of $R_5$, $R_6$, $R_7$, $R_A$ and $R_B$ is an alkyl group.

19. The composition defined in claim 16, wherein the compound is 2,2,6-Trimethyl-1,3-dioxen-4-one.

20. The composition defined in claim 16, wherein the cyclic ether compound comprises about 0.1 to about 2 percent by weight.

21. The composition of claim 16 wherein the fuel is a diesel fuel.

22. The composition of claim 17 wherein the fuel is a diesel fuel.

23. The composition of claim 10 wherein the fuel is a diesel fuel.

24. The composition of claim 20 wherein the fuel is a diesel fuel.

25. The composition defined in claim 16 wherein at least one of $R_5$, $R_6$, $R_7$, $R_A$, and $R_B$ is an aromatic group.

26. The composition as defined in claim 25 wherein said fuel is a diesel fuel.

27. The composition defined in claim 25 wherein said fuel is a middle distillate fuel.

28. A composition comprising a liquid hydrocarbon middle distillate fuel and at least 0.05 percent by weight of one or more cyclic ether compounds having the formula:

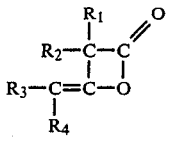

(I)

or

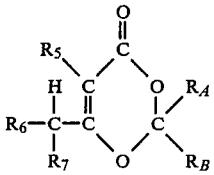

(II)

wherein $R_1$, $R_2$, $R_3$, $R_4$, $R_5$, $R_6$, $R_7$, $R_A$, and $R_B$ are the same or different groups selected from hydrogen and organo groups.

29. The composition defined in claim 28, wherein at least one of $R_1$, $R_2$, $R_3$, and $R_4$, and at least one of $R_5$, $R_6$, $R_7$, $R_A$, and $R_B$ is an acyclic group.

30. The composition defined in claim 28, wherein at least one of $R_1$, $R_2$, $R_3$, and $R_4$, and at least one of $R_5$, $R_6$, $R_7$, $R_A$, and $R_B$ is an alkyl group.

31. The composition defined in claim 28, wherein the cyclic ether comprises diketene.

32. The composition defined in claim 28, wherein the cyclic ether comprises 2,2,6-Trimethyl-1,3-dioxen-4-one.

33. The composition defined in claim 28, including 0.05 to 10 percent by weight cyclic ether compound.

34. The composition defined in claim 31, wherein cyclic ether compound comprises about 0.05 to about 10 percent by weight.

35. The composition defined in claim 32, wherein cyclic ether compound comprises about 0.05 to about 5 percent by weight.

36. The composition defined in claim 29, wherein cyclic ether compound comprises about 0.1 to about 2 percent by weight.

37. The composition defined in claim 28, wherein the fuel is suitable for use in a diesel engine.

38. The composition of claim 29 wherein the fuel is a diesel fuel and the fuel contains one or more compounds conforming to formula (I) in a concentration of at least 0.05 percent by weight.

39. The composition of claim 30 wherein the fuel is a diesel fuel and the fuel contains one or more compounds conforming to formula (II) in a concentration of at least 0.05 percent by weight.

40. The composition of claim 33 wherein the ether compound conforms to formula (II).

41. The composition of claim 36 wherein the ether compound conforms to formula (I).

42. A composition comprising diesel fuel and about 0.05 to about 5 percent by weight of a cyclic ether compound having the formula:

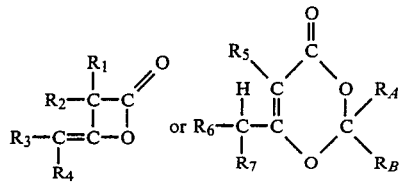

wherein $R_1$, $R_2$, $R_3$, $R_4$, $R_5$, $R_6$, $R_7$, $R_A$, or $R_B$ are the same or different groups selected from hydrogen and organo groups.

43. The composition defined in claim 42, wherein at least one of $R_1$, $R_2$, $R_3$, and $R_4$, and at least one of $R_5$, $R_6$, $R_7$, $R_A$, and $R_B$ is an acyclic group.

44. The composition defined in claim 42, wherein at least one of $R_1$, $R_2$, $R_3$, and $R_4$, and at least one of $R_5$, $R_6$, $R_7$, $R_A$, and $R_B$ is an alkyl group.

45. The composition defined in claim 42, wherein the cyclic ether compound is diketene.

46. The composition defined in claim 42 wherein the cyclic ether compound is 2,2,6-Trimethyl-1,3-dioxen-4-one.

47. The composition defined in claim 42, wherein the cyclic ether compound comprises about 0.1 to about 2 percent by weight.

48. The composition of claim 45 wherein the diketene is present in a concentration from about 0.1 to 2 percent by weight.

49. The composition of claim 46 wherein the 2,2,6-Trimethyl-1,3-dioxen-4-one is present in a concentration between about 0.1 and 2 percent by weight.

50. A method for increasing the cetane number of a liquid hydrocarbon fuel, comprising adding to the fuel at least about 0.05 percent by weight of at least one cyclic ether compound having a ring structure containing a

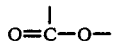

group with both the available carbon and oxygen atoms being members of the same ring.

51. The method defined in claim 50, wherein the cyclic ether has the formula:

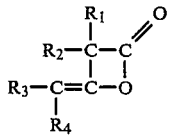

wherein $R_1$, $R_2$, $R_3$, and $R_4$ are the same or different groups selected from hydrogen and organo groups.

52. The method defined in claim 50, wherein the cyclic ether has the formula:

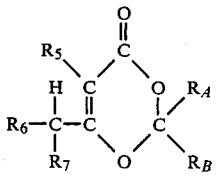

wherein $R_5$, $R_6$, $R_7$, $R_A$, and $R_B$ are the same or different groups selected from hydrogen and organo groups.

53. The method defined in claim 50, wherein the fuel is diesel fuel.

54. The method defined in claim 50, wherein the cyclic ether is dissolved in the fuel.

55. The method defined in claim 50, wherein the cyclic ether is dissolved in a cosolvent, which is soluble in the fuel.

56. The method defined in claim 50, wherein the cyclic ether comprises up to about 10 percent by weight.

57. The method defined in claim 52, wherein the cyclic ether comprises up to about 5 percent by weight.

58. The method defined in claim 51, wherein the cyclic ether comprises about 0.1 to about 2 percent by weight.

59. The method defined in claim 50, wherein the cyclic ether comprises diketene.

60. The method defined in claim 50, wherein the cyclic ether comprises 2,2,6-Trimethyl-1,3-dioxen-4-one.

61. The method of claim 51 wherein said fuel is diesel fuel.

62. The method of claim 52 wherein said fuel is diesel fuel.

63. The method of claim 56 wherein said fuel is diesel fuel.

64. The method of claim 57 wherein said fuel is diesel fuel.

65. The method of claim 58 wherein said fuel is diesel fuel.

66. The method of claim 59 wherein said fuel is diesel fuel.

67. The method of claim 60 wherein said fuel is diesel fuel.

68. A composition comprising a liquid hydrocarbon fuel and a diketene-carbonyl adduct dissolved in said fuel in a concentration from about 0.05 to 10 percent by weight.

69. A composition as defined in claim 68 wherein the fuel is a middle distillate.

70. A composition as defined in claim 68 wherein the fuel is a diesel fuel.

71. A composition comprising a liquid hydrocarbon fuel and an adduct of a beta-lactone with a compound selected from the group consisting of aldehydes and ketones, said adduct being dissolved in said fuel in a concentration of at least 0.05 percent by weight.

72. A composition as defined in claim 71 wherein the fuel is a middle distillate.

73. A composition as defined in claim 71 wherein the fuel is a diesel fuel.

74. A composition comprising a liquid hydrocarbon fuel and one or more cyclic ether compounds having a ring structure containing a

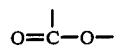

group with both the available carbon atom and oxygen atom of said group being members of the same ring, said cyclic ether compound being dissolved in said fuel in a concentration sufficient to increase the cetane number of the fuel.

75. A composition as defined in claim 74 wherein the fuel is a middle distillate.

76. A composition as defined in claim 74 wherein the fuel is a diesel fuel.

77. A composition comprising a diesel fuel and diketene present in said fuel in a concentration of at least 0.05 percent by weight.

78. A composition comprising a diesel fuel and 2,2,6-Trimethyl-1,3-dioxen-4-one present in said fuel in a concentration of at least 0.05 percent by weight.

* * * * *

UNITED STATES PATENT AND TRADEMARK OFFICE

CERTIFICATE OF CORRECTION

PATENT NO. : 4,738,686

DATED : April 19, 1988

INVENTOR(S) : Diane M. Dillon and Peter J. Jessup

It is certified that error appears in the above-identified patent and that said Letters Patent is hereby corrected as shown below:

Column 6, line 55, delete "cyclic ether".

Signed and Sealed this

Fifteenth Day of November, 1988

*Attest:*

DONALD J. QUIGG

*Attesting Officer*

*Commissioner of Patents and Trademarks*